US005237954A

United States Patent [19]

Evans

[11] Patent Number: 5,237,954

[45] Date of Patent: Aug. 24, 1993

[54] PORTABLE PONTOON BOAT

[76] Inventor: Paul A. Evans, 5111 Fontaine St. #111, San Diego, Calif. 92120

[21] Appl. No.: 941,925

[22] Filed: Sep. 8, 1992

[51] Int. Cl.[5] ..... B63B 1/12

[52] U.S. Cl. ..... 114/352; 114/61

[58] Field of Search ..... 114/352-354, 114/357, 61, 363; 441/35, 129, 130, 44

[56] References Cited

U.S. PATENT DOCUMENTS

| | | | |
|---|---|---|---|
| 2,916,748 | 12/1959 | Stahmer | 114/352 |
| 4,496,325 | 1/1985 | Tweg | 114/354 |
| 4,829,926 | 5/1989 | Voelkel | 114/354 |

FOREIGN PATENT DOCUMENTS

| | | | |
|---|---|---|---|
| 362711 | 1/1921 | Fed. Rep. of Germany | 114/353 |

*Primary Examiner*—Edwin L. Swinehart

*Attorney, Agent, or Firm*—Ralph S. Branscomb

[57] ABSTRACT

A small disassembleable boat is comprised of four pontoons which together define the corners of a rectangle, with each pontoon being made from two halfshells flanged together so that they can be disassembled and seated one inside the other to conserve space for transport. For use as a boat, the halfshells are bolted together through substantially continuous peripheral flanges, with the flanges also serving as mounting points for the boat frame and a superstructure which supports a bench-type seat for the operator above a central deck portion supported on the underlying frame. Optional foredeck panels, aft deck panels, and a transom for use with an outboard motor are provided.

9 Claims, 3 Drawing Sheets

Fig. 1
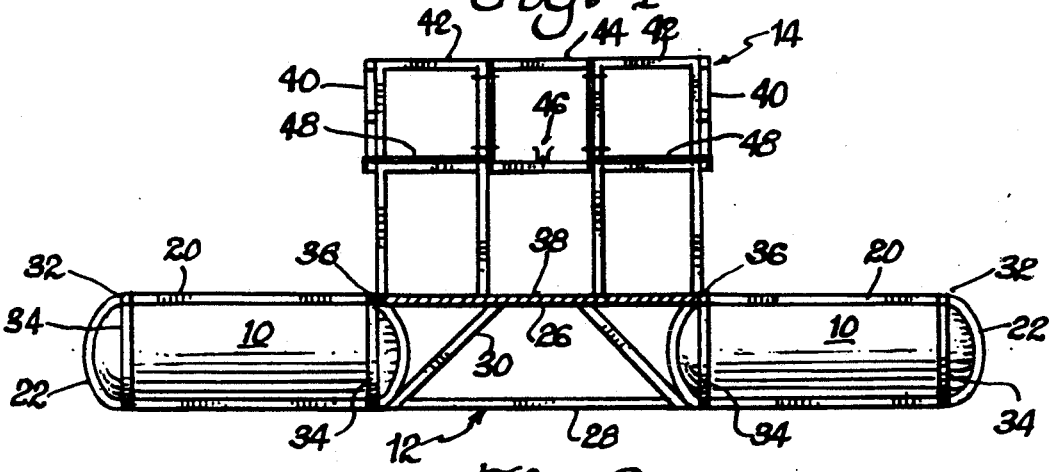
Fig. 2
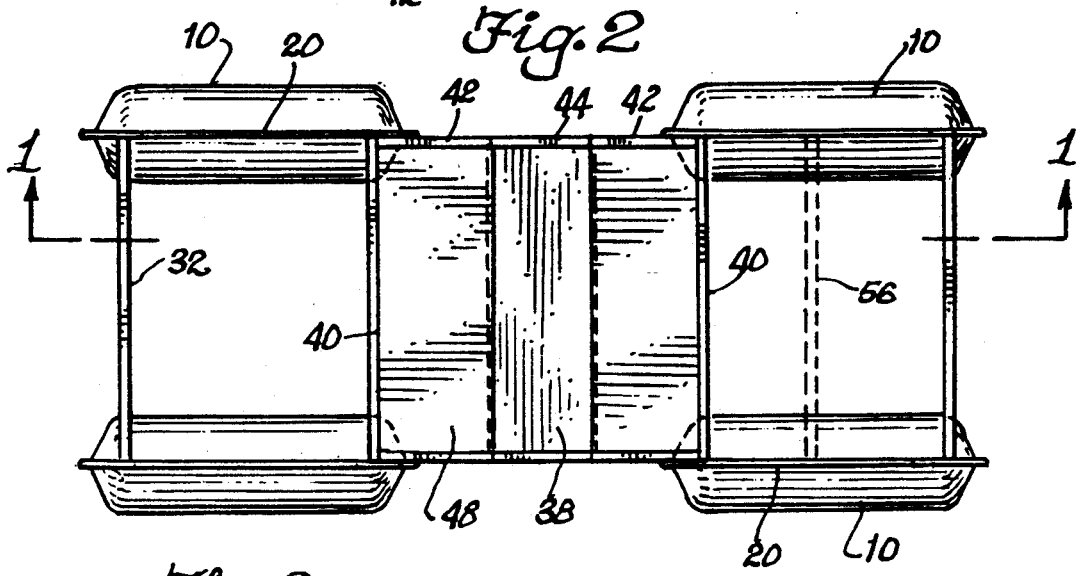
Fig. 3
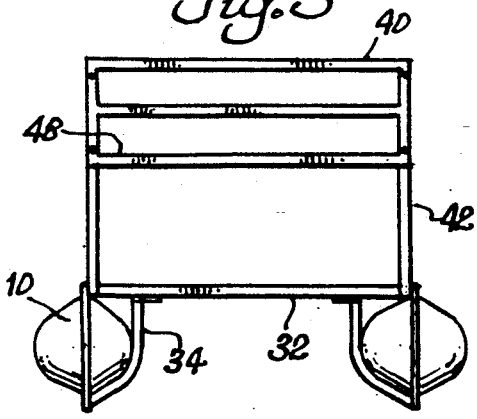
Fig. 4
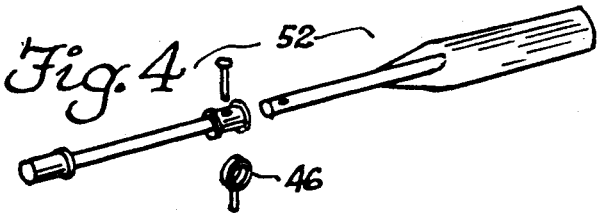
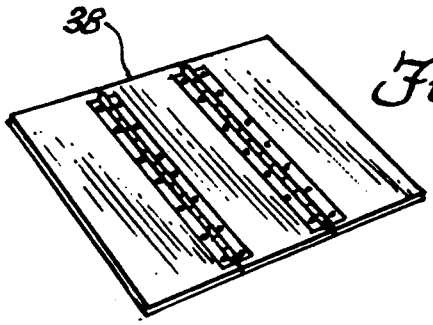
Fig. 5
Fig. 6
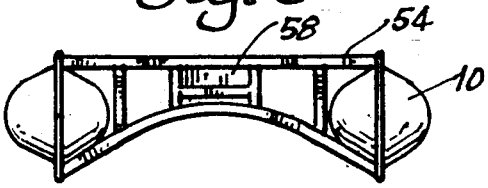

Fig. 7
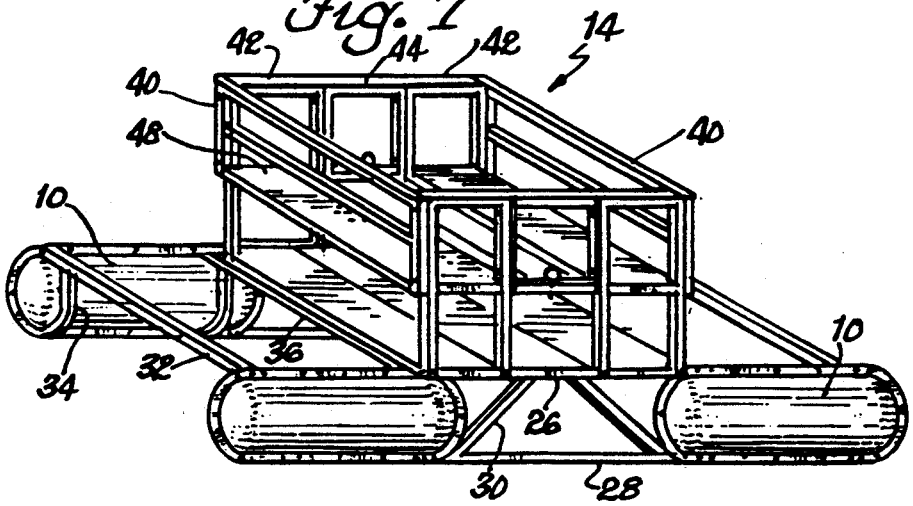
Fig. 8
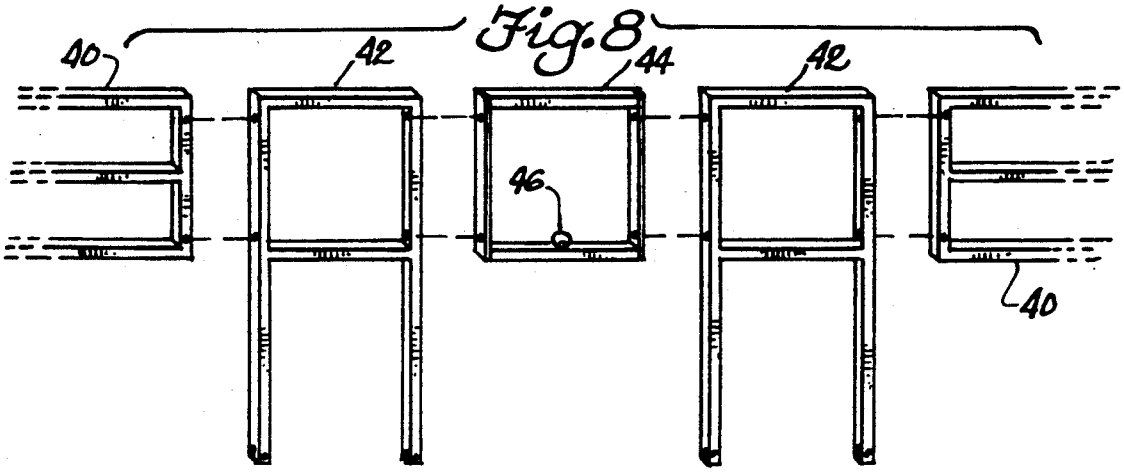
Fig. 9
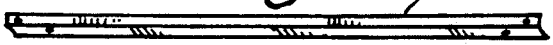
Fig. 10
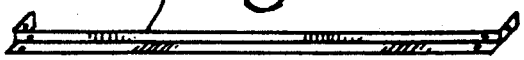
Fig. 11
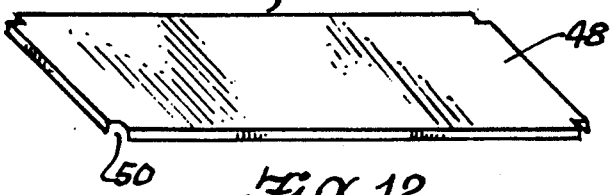
Fig. 12
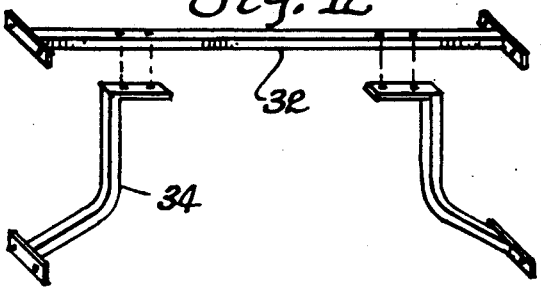
Fig. 13
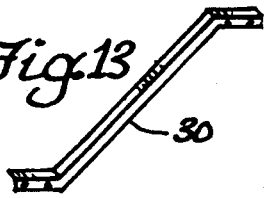
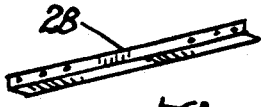
Fig. 14

PORTABLE PONTOON BOAT

BACKGROUND OF THE INVENTION

The instant invention is in the field of small boats, and particularly pertains to disassembleable boats, on the order of the size necessary to permit the entire boat to fit within a car trunk.

There are toy boats that fit within this category, and larger, expensive inflatables that will compact into a fairly small space, but these are very expensive. Also, the relatively high-pressure inflated portions of full-size dingies such as the Zodiac TM require extensive inflating at a relatively high pressure in order to be ready for use.

There is a need for a boat which, when disassembled can fit within the trunk of an average car, and once assembled, can be as rigid as a conventional rowboat, thus avoiding the necessity of a source of relatively high-pressure air.

SUMMARY OF THE INVENTION

The invention fulfills the above stated need by providing a pontoon-type boat consisting of four pontoons, each of which is longitudinally split into two halfshells that mate together and are secured along a continuous peripheral flange.

An open deck structure is attached to the pontoons at the flanges and holds them at a quadrilateral configuration, and a superstructure mounts atop the frame and supports a bench-type seat and a pair of oarlocks, both of which are positioned over a deck supported on the frame so that the user can sit on the bench with his feet on the underlying deck and row the boat.

Optional features include foldable deck panels for the front and rear portions of the frame, and a transom for an outboard motor.

All of the parts of both the deck and the frame can be broken down into a series of components that are no longer than 45 inches and the halfshells of the pontoons nest, which is why the entire structure will fit in a trunk. Were the pontoons non-nestable, because of their buoyancy requirements and volume, they would define a major limitation on the space required to house the collapsed assembly.

BRIEF DESCRIPTION OF THE DRAWINGS

FIG. 1 is a section taken along line 1—1 of FIG. 2;

FIG. 2 is a top plan view of the assembled boat;

FIG. 3 is an end elevation view of the assembled boat;

FIG. 4 is a perspective view of a two-piece oar;

FIG. 5 is a perspective view of a foldable deck panel;

FIG. 6 is a rear elevation view of the deck and pontoon portion of the boat with the transom in place;

FIG. 7 is a perspective view of the assembled boat;

FIG. 8 illustrates the parts used to construct the quadrilateral cage superstructure;

FIG. 9 illustrates the longitudinal strut between the tops of the pontoons which also supports the main deck;

FIG. 10 illustrates a transverse deck support member which overlies the frame to support the deck at the fore and aft end;

FIG. 11 illustrates the bench-type seat supported in the frame;

FIG. 12 illustrates a crossbar, one of four which are used to define the lateral support portions of the frame, together with their curved under braces;

FIG. 13 illustrates the diagonal braces providing triangulation strength between the longitudinal support struts;

FIG. 14 illustrates the bottom support struts;

DETAILED DESCRIPTION OF THE PREFERRED EMBODIMENT

The 3 basic general parts of the boat comprise the individual pontoon 10, the frame 12 which comprises the individual members necessary to maintain the pontoons in position and support the superstructure, and the superstructure itself, 14.

Figure 16:
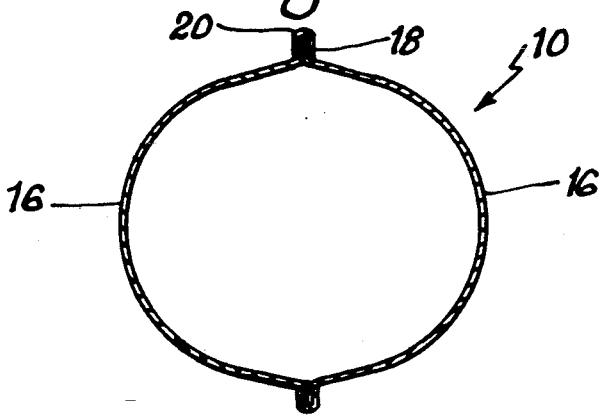
FIG. 16 is a transverse section through an assembled pontoon.
Figure 17:
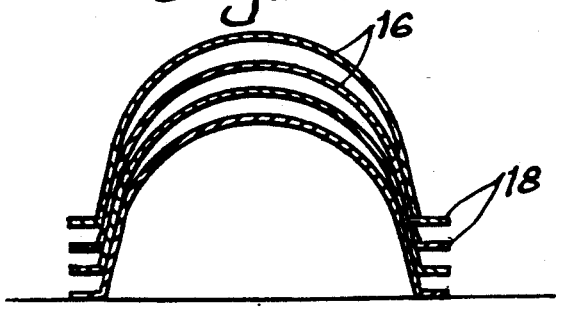
FIG. 17 illustrates the nesting capability of the separated pontoon halves.

The pontoons are preferably of aluminum construction, as the shape of each pontoon halfshell 16 lends itself well to being die-stamped in aluminum in an inexpensive and well-known process. The pontoon halves 16 each peripherally terminate in a continuous flange 18. The pontoon halves are identical to facilitate manufacture and assembly, and in cross-section are slightly less than semicircular as shown in FIG. 16, which also applies to longitudinal sections, so that the halfshells will nest as shown in FIG. 17.

Figure 15:
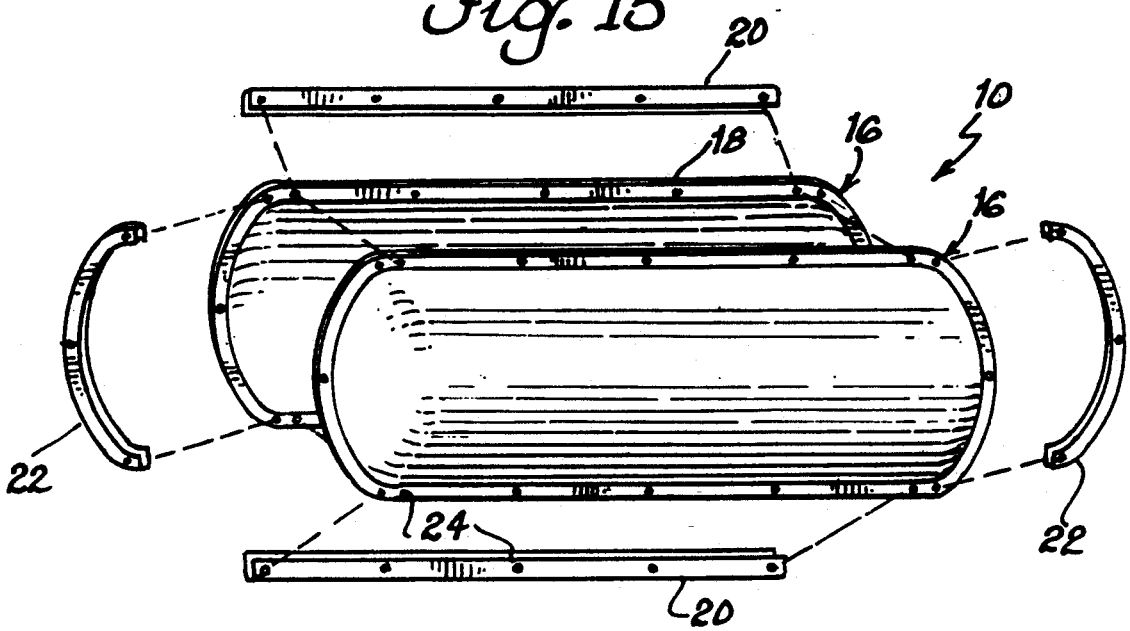
FIG. 15 is an exploded perspective view of a pontoon as it is disassembled.

The pontoons have an overall length of about 45 inches, but in no case greater than 48 inches. When assembled, any two of the halfshells can be mated together as can be visualized from FIG. 15, and held in place by the straight U-shaped channels 20 and the curved channels 22. Once these channels are in place, they will frictionally hold the pontoon together with the corresponding bolt holes 24 in place, but not necessarily bolted together at this point inasmuch as other parts of the structure need to be included within the flange bolts.

The pontoons are arranged in a rectangle-forming configuration as shown in FIG. 7. The longitudinally aligned pontoon pair on the right of the boat, as well as the pair on the left, are connected by means of longitudinal struts 26 on the top and 28 on the bottom, with the struts being reinforced by the triangulation established by the diagonal braces 30 shown in FIG. 13. The lower ends of the diagonal braces are bolted to the pontoon flanges along with the bottom struts 28, with the upper ends of the diagonal braces being bolted to the longitudinal deck support 26.

This construction basically rigidifies the left and right longitudinal pontoon pairs, which are then laterally rigidified by transverse cross-bars 32 detailed in FIG. 12. These crossbars bolt to the upper portion of the flange 18 at four points corresponding to the approximate front and rear of each of the pontoons, and each crossbar is further supported by the curved underbrace 34 also shown in FIG. 12 which mounts to the bottom portions of the flanges 18.

With the structure thus described in place, a basic, substantially planar four-point flotation structure is completed. To add the superstructure, first, forward and aft transverse deck supports 36 as shown in FIG. 10 are suitably mounted to the longitudinal struts so that a continuous rectangular lip is formed to support the main deck 38 shown in perspective in FIG. 5. Overlying the main deck, and mounted to the frame, are a series of open, generally rectangular members as shown in FIG.

8, which together define the peripherally enclosed cage of the superstructure 14. Longated seat back rests 40 are mounted to generally A-shaped members 42 which are bolted at their bottoms to the top longitudinal struts 26, and are spaced by square spacers 44 which also may optionally support oarlocks 46. It should be clear from an inspection of FIGS. 7 and 8 how these members fit together. They are bolted together at adjacent surfaces through the boltholes illustrated.

A pair of planar bench-type seats element 48 shown in FIG. 11, which may be provided singly or in pairs, rests inside the fore or aft, or both, portions of the superstructure as shown in FIG. 7. The notched corners 50 of the bench-type seat permit the benches to fit closely into and overlap the appropriate structural members of the superstructure.

The boat as thus described is complete for use by a single oarsman, using conventional oars, or the two-piece oar 52 illustrated in FIG. 4. Naturally, the two-piece construction is designed to enable the oar to fit within the confines of the remaining structure, that is, being on the order of 45 inches long per half. Several other features that are optional still remain to be described. Most importantly, a transom 54, made out of the same basic square tubular construction as the rest of the superstructure and frame, can be mounted to the upper and lower flanges of the pontoon at the position indicated at 56 in FIG. 2. The transom is of somewhat arbitrary construction provided it has the flange mounts, and the planar central outboard motor-mounting portion 58.

Additionally, decks such as the foldable deck shown in FIG. 5 may be used to cover the foreframe or afterframe, being defined as portions of the frame fore and after the superstructure to define a foredeck and an afterdeck.

The boat as described and claimed herein will take an estimated 30 minutes to assemble, and when the superstructure, frame and decks are completely collapsed, they will fit in a space that is 45 inches wide. This permits the entire structure to be disassembled and transported in the trunk of a car. In mass production, the entire structure can be made inexpensively, and when assembled is a durable and stable craft, ideal for use by one or two users.

It is hereby claimed:

1. A collapsible pontoon boat comprising:

(a) four elongated pontoons;

(b) a collapsible frame releasably mounting said pontoons longitudinally extended in a laterally and longitudinally spaced configuration substantially defining the corners of a rectangle;

(c) a collapsible seat-defining superstructure removably mounted on said frame such that said pontoons can be removed from said frame and said frame and superstructure collapsed such that said boat is compact for transport; and, (d) said pontoons being each comprised of mating halfshells which mate to form a sealed flotation unit, and when separated nest together to minimize stored volume.

2. Structure according to claim 1 wherein said halfshells are substantially identical such that each halfshell can mate with any other halfshell to define a pontoon.

3. Structure according to claim 2 wherein said halfshells each define substantially continuous mating flanges and said frame connects to said flanges.

4. A collapsible pontoon boat comprising:

(a) four elongated pontoons;

(b) a collapsible frame releasably mounting said pontoons longitudinally extended in a laterally and longitudinally spaced configuration substantially defining the corners of a rectangle;

(c) a collapsible seat-defining superstructure removably mounted on said frame such that said pontoons can be removed from said frame and said frame and superstructure collapsed such that said boat is compact for transport; and, (d) said pontoons each defining top and bottom mating flanges and said pontoon configuration comprising two aft and two forward pontoons defining left and right longitudinally aligned pontoon pairs, and said frame comprises top and bottom longitudinal struts spanning between the pontoons of each pontoon pair and mounting to the respective mating flanges at the tops and bottoms of the respective pontoons, and including crossbars laterally spaced between the aft pontoons and the forward pontoons and mounting to the respective top flanges thereof.

5. Structure according to claim 4 and including curved braces mounted to and between the respective bottom flanges of said pontoon and respective ones of said crossbars to support said crossbars from both the top and bottom flanges of said pontoons.

6. Structure according to claim 5 wherein said superstructure mounts to said frame members and includes a planar main deck support on said frame at the bottom of said superstructure.

7. Structure according to claim 6 wherein said superstructure mounts a pair of removable benches above said main deck to permit a person to sit on said bench with his feet on said main deck.

8. Structure according to claim 7 wherein said superstructure defines oarlocks on opposite sides thereof usable by a person sitting on said bench and including two two-piece collapsible oars.

9. A collapsible pontoon boat comprising:

(a) four elongated pontoons;

(b) a collapsible frame releasably mounting said pontoons longitudinally extended in a laterally and longitudinally spaced configuration substantially defining the corners of a rectangle;

(c) a collapsible seat-defining superstructure removably mounted on said frame such that said pontoons can be removed from said frame and said frame and superstrucutre collapsed such that said boat is compact for transport;

(d) a transverse transom member removably mountable to a rear portion of said boat;

(e) said pontoons including two laterally spaced aft pontoons and said transom being mounted between said aft pontoons; and, (f) said aft pontoons each having a substantially continuous longitudinal flange surrounding the perimeter thereof and said transom being mounted to said flanges.

* * * * *